US006575609B2

(12) United States Patent
Taniuchi et al.

(10) Patent No.: US 6,575,609 B2
(45) Date of Patent: Jun. 10, 2003

(54) VEHICLE HEADLIGHT

(75) Inventors: Hitoshi Taniuchi, Tokyo (JP); Hiroshi Iwasaki, Musashino (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 10/213,378

(22) Filed: Aug. 7, 2002

(65) Prior Publication Data

US 2002/0186565 A1 Dec. 12, 2002

Related U.S. Application Data

(63) Continuation of application No. 10/025,975, filed on Dec. 26, 2001.

(30) Foreign Application Priority Data

Dec. 25, 2000 (JP) ..... 2000-392979
Jun. 22, 2001 (JP) ..... 2001-190196
Aug. 14, 2001 (JP) ..... 2001-245977

(51) Int. Cl.[7] ..... F21V 7/00

(52) U.S. Cl. ..... 362/517; 362/297; 362/346; 362/512

(58) Field of Search ..... 362/512, 516, 362/517, 538, 539, 297, 298, 302, 303, 346, 351, 277, 319

(56) References Cited

U.S. PATENT DOCUMENTS 5,899,559 A 5/1999 Lachmayer et al. ..... 362/513
5,967,647 A * 10/1999 Eichler ..... 362/299
6,152,589 A * 11/2000 Kawaguchi et al. ..... 362/304
6,419,380 B2 * 7/2002 Oyama et al. ..... 362/297
6,454,448 B2 * 9/2002 Taniuchi et al. ..... 362/346
2002/0089853 A1 * 7/2002 Taniuchi et al. ..... 362/297

FOREIGN PATENT DOCUMENTS

EP 1 126 210 A2 8/2001 ..... F21S/8/10

* cited by examiner

*Primary Examiner*—Thomas M. Sember
*Assistant Examiner*—John Amarantides
(74) *Attorney, Agent, or Firm*—Morgan, Lewis & Bockius LLP

(57) ABSTRACT

A vehicle headlight can include a light source, first and second ellipse group reflecting surfaces having a focus corresponding to the light source, a first parabolic group reflecting surface with a focus on a second focus of the second ellipse group reflecting surface, and a second parabolic group reflecting surface with a focus corresponding to the position of the light source. A movable shutter can be provided with a shutter part and a shade part. When the shade part is placed in the light flux of the first ellipse group reflecting surface, the shade part shades the light flux irradiating from the light source to the second parabolic group reflecting surface. On the other hand, when the shutter part is withdrawn from the light flux, the second parabolic group reflecting surface can receive light. The second ellipse group reflecting surface can reflect unused light from the first ellipse group reflecting surface toward the first parabolic group reflecting surface, and the first parabolic group reflecting surface can reflect the light in the irradiation direction. Thus, the low-beam distribution and the high-beam distribution can be improved in illumination. Furthermore, the light from the second parabolic group reflecting surface that is to be projected in the front direction can be added to the light reflected from the first ellipse group reflecting surface to improve the visibility in the front of the vehicle during high-beam distribution.

21 Claims, 4 Drawing Sheets

VEHICLE HEADLIGHT

This invention claims the benefit to Japanese Patent Applications No. 2001-245977, filed on Aug. 14, 2001, the disclosure of which is hereby incorporated by reference. This application also claims priority to U.S. patent application Ser. No. 10/025,975 filed on. Dec. 26, 2001, entitled, "Vehicle Light Capable Of Changing Light Distribution Pattern Between Low-Beam Mode And High-Beam Mode By Movable Shade And Reflecting Surface," the disclosure of which is hereby incorporated by reference.

BACKGROUND OF THE INVENTION

1. Field of the Invention

The present invention relates to a vehicle lamp, and more particularly to a vehicle headlight generally referred to as a projector-type headlight (Poly Ellipsoid Headlamp; PES) using an ellipse group reflecting surface (e.g., a spheroid reflecting surface), a projection lens with an aspheric surface, and a shutter for adjusting a light distribution characteristic. The light can be configured to switch between a meeting-beam (or low-bean) distribution and a running-beam (or high-beam) distribution.

2. Description of the Related Art

Referring now to FIG. 1, a conventional projector-type headlight 90 will be described. The projector-type headlight 90 comprises a light source 91, an ellipse group reflecting surface 92, a shutter 93, and a projection lens 94. The ellipse group reflecting surface 92 is a reflecting surface configured as a spheroid, a complex ellipse, or the like, having a first focus f1 and a second focus f2. The light source 91 is arranged at a position corresponding to the first focus f1, while the shutter 93 is arranged at a position in the vicinity of the second focus f2 of the ellipse group reflecting surface 92. The focus of the projection lens 94 is arranged in the vicinity of the shutter 93. In the projector-type headlight 90 thus constructed, the movement of the shutter 93 allows a desired low-beam distribution pattern and a desired high-beam distribution pattern in a selective manner.

More specifically, in a vehicle headlight constructed as described above, a light beam from the light source 91 is reflected by the ellipse group reflecting surface 92 and is then provided as reflection light having a generally circular cross section that converges at the second focus. A lower half of the reflection light is shaded when the shutter 93 is placed in the optical path of the reflection light. Thus, the resulting reflected light is shaped as a generally upper semicircular part. The generally upper semicircular part of the reflected light is projected in the irradiation direction and turned upside down by the projection lens 94 to become a lower semicircular part of the reflected light. In other words, as shown in FIG. 2, a light distribution pattern HS suited for low-beam distribution, which does not include high beam light rays, can be obtained.

On the other hand, the shutter 93 may be configured to be movable. If a high-beam distribution pattern is required, the shutter 93 can be withdrawn from the optical path of the light reflected from the reflecting surface 92. Thus, the lower semicircular part of the reflected light which can form a high bean and which is shaded by the shutter 93 in low-beam mode is allowed to be projected as irradiation light, resulting in a high-beam distribution pattern HM as shown in FIG. 3.

In the conventional projector-type headlight 90, however, the lower half of the reflected light from the ellipse group reflecting surface 92 is shaded at the time of low-beam distribution. As a result, the amount of light provided by the low-beam distribution can be poor in supply. To solve such a disadvantage, in general, an insufficient amount of light is compensated by, for example, inclining the optical axis of the headlight to the lower left side when it is intended for driving on the left-hand side (In Japan, automotive vehicles drive on the left side) such that the portion corresponding to the point P that has a high degree of brightness is not shaded by the shutter 93 (see FIG. 2).

On the other hand, if the shutter 93 is withdrawn from the above configuration of the headlight which provides adequate low-beam distribution, there is not enough irradiated light directed to the front (see FIG. 3). Therefore, there is another problem in that there is insufficient distance visibility for high-beam distribution.

In the projector-type headlight 90, generally, there is a further problem of poor visibility in both left and right directions because the width of irradiation light in these directions is not enough.

SUMMARY OF THE INVENTION

In order to solve the above and other problems of the conventional art, therefore, it is an object of the present invention to provide a projector-type vehicle headlight, by which a low-beam distribution and a high-beam distribution can be selectively employed, and unused light can be effectively used as reflection light in each of the low- and high-beam distributions. The projector-type headlight is especially capable of attaining a sufficient illumination in the high-beam distribution.

Furthermore, it is another object of the present invention to provide a headlight capable of improving visibility by applying a sufficient illumination in both left and right directions at the time of high-beam distribution.

In order to attain the objects of the invention, a vehicle headlight according to the present invention can be embodied in a device that includes a light source; a first ellipse group reflecting surface having an optical axis direction substantially corresponding to the irradiation direction of the headlight, the first ellipse group reflecting surface having a first focus and a second focus, the first focus being located substantially at the light source, the first ellipse group reflecting surface configured to reflect light irradiated from the light source in the irradiation direction of the headlight; a projection lens having a focus in the irradiation direction of the headlight and in the vicinity of the second focus of the first ellipse group reflecting surface, the projection lens configured to project light irradiated from the light source and light reflected from the first ellipse group reflecting surface in the irradiation direction; a second ellipse group reflecting surface having an optical axis crossing the optical axis of the first ellipse group reflecting surface, the second ellipse group reflecting surface having a primary focus and a secondary focus, the primary focus of the second ellipse group reflecting surface located substantially at the light source; a first parabolic group reflecting surface having a focus located substantially at the secondary focus of the second ellipse group reflecting surface, the first parabolic group reflecting surface configured to reflect light reflected from the second ellipse group reflecting surface in the irradiation direction of the headlight; a second parabolic group reflecting surface having an optical axis substantially corresponding to the irradiation direction of the headlight, the second parabolic group reflecting surface having a focus located in the vicinity of-the light source, the second parabolic group reflecting surface being arranged in the irradiation direction side from the first ellipse group reflecting surface; and a shutter provided in the vicinity of the focus of the projection lens, the shutter being capable of being placed in and withdrawn from an optical path of light reflected from the first ellipse group reflecting surface, the shutter having a shutter part and a shade part, the shutter part providing a low-beam light distribution pattern by being placed in the optical path of the reflected light from the first ellipse group reflecting surface and providing a high-beam light distribution pattern by being withdrawn from the optical path, the shade part shading light traveling from the light source to the second parabolic group reflecting surface when the shade is in a first position, and providing light from the light source to the second parabolic group reflecting surface when the shade is in a second position.

In the above configuration of the vehicle headlight, at first, when the headlight is in the low-beam distribution (which is normally used), unused light from the first ellipse group reflecting surface is captured on the second ellipse group reflecting surface, and the captured light is then projected from the first parabolic group reflecting surface toward the irradiation direction to allow the headlight to provide more illumination in the low-beam distribution. Therefore, there is an extremely superior effect in improvement of visibility in the low-beam distribution.

The high-beam distribution pattern can be constructed such that it is compensated with light being irradiated like a spot illumination in a direction towards the front of the vehicle by the second parabolic group reflecting surface. In the conventional art, on the other hand, such a high-beam distribution pattern is insufficient because it is inclined to the lower left side for increasing the visibility in the low-beam distribution. The headlight of the invention can also be configured such that the distribution of light from the first parabolic group reflecting surface is added to the high-beam distribution pattern. Consequently, an extremely superior effect in improvement of visibility at each of the low- and high-beam distributions can be attained. In addition to the above, sufficient illumination can be provided in the left and right directions.

In the embodiment of the vehicle headlight as described above, it is preferable to arrange the first ellipse group reflecting surface and the second ellipse group reflecting surface such that the second focus of the first ellipse group reflecting surface is on the outside of the second ellipse group reflecting surface. Also, it is preferable to locate the shutter part of the movable shutter on a back side of the second ellipse group reflecting surface when the shutter part is withdrawn from the optical path of the reflected light from the first ellipse group reflecting surface.

In one of the preferred embodiments, the movable shutter may be rotatably fixed on a substantially horizontal axis to be placed in or withdrawn from the optical path of the headlight.

It is preferred that the second parabolic group reflecting surface be composed of a pair of reflecting surfaces provided on left and right sides of the first ellipse group reflecting surface in the horizontal direction such that the second parabolic group, reflecting surface receives direct light from the light source when the movable shutter is withdrawn.

Preferably, the vehicle headlight according to the present invention includes shading means for shading the light reflected from the second ellipse group reflecting surface to the first parabolic group reflecting surface when a high-beam distribution is achieved. The shading means may be driven independently of the movable shutter. Alternatively, the shading means may be interlocked with the movable shutter. The shading means and the movable shutter may be rotated around a substantially horizontal axis.

In the embodiment of the vehicle headlight described above, the second ellipse group reflecting surface preferably has an opening portion coinciding with a part of a light path of irradiation light from the light source and reflected light from the first ellipse group reflecting surface to the projection lens. In this case, the movable shutter can shade a part of the opening portion when it is placed in the optical path, and open the opening portion when it is withdrawn from the optical path.

Further, in the vehicle headlight with the afore-mentioned constitution, the optical axis of the first parabolic group reflecting surface generally and preferably corresponds to the irradiation direction of the headlight.

In the vehicle headlight with the constitution above, it is preferable to set the optical axis of the first parabolic group reflecting surface such that the reflected light from the first parabolic group reflecting surface outwardly irradiates on a side of the irradiated area of the reflected light from the first ellipse group reflecting surface.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Hereinafter, vehicle headlights according to the present invention will be described based on preferred embodiments with reference to the accompanying drawings.

In the present specification, the term "ellipse group reflecting surface" can be defined as a curved surface having an ellipse or its similar shape as a whole, such as a rotated elliptic surface (spheroid), a complex elliptic surface, an ellipsoidal surface, an elliptic cylindrical surface, an elliptical free-curved surface, or combination thereof. If a light source is located on a first focus of the ellipse group reflecting surface, light rays emitted from the light source converge to a second focus of the ellipse group reflecting surface.

The term "parabolic group reflecting surface" can be defined as a curved surface having a parabola or similar shape as a whole, such as a rotated parabolic surface, a complex parabolic surface, a paraboloidal surface, a parabolic free-curved surface, or combination thereof. Light rays emitted from a light source located on a focus of the parabolic group reflecting surface are reflected to be parallel to the axis of the parabolic group reflecting surface.

Figure 1:
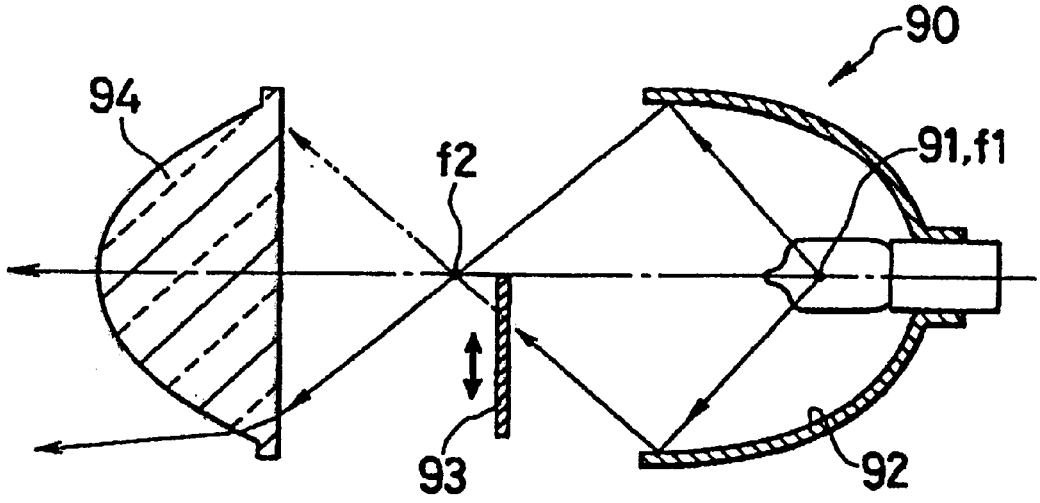
Fig.1 CONVENTIONAL ART
FIG. 1 is a cross sectional view illustrating a conventional headlight.
Figure 2:
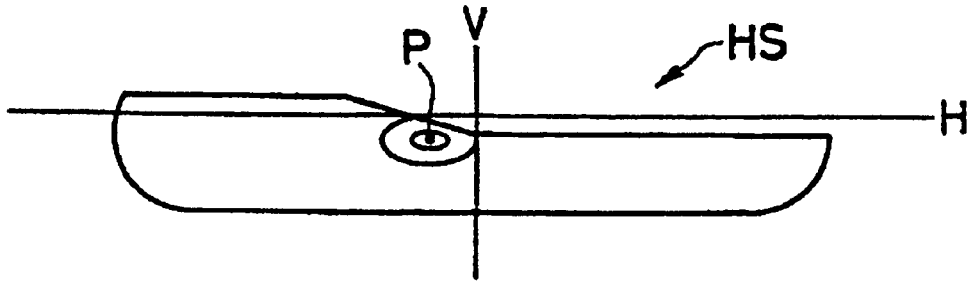
Fig.2 CONVENTIONAL ART
FIG. 2 is an explanatory view showing a low-beam distribution pattern of the conventional headlight.
Figure 3:
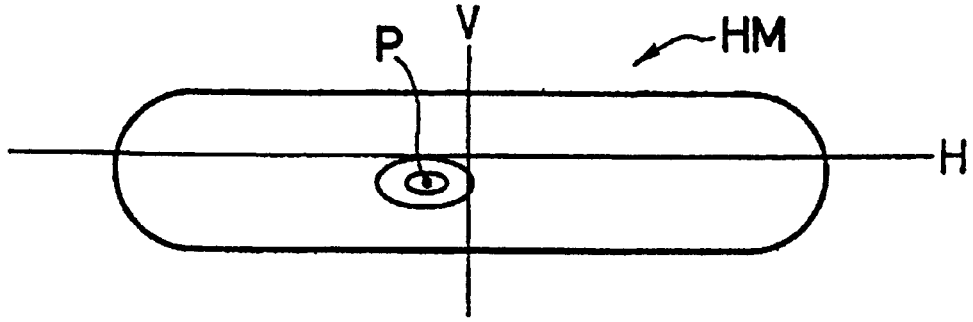
Fig.3 CONVENTIONAL ART
FIG. 3 is an explanatory view showing a high-beam distribution pattern of the conventional headlight.
Figure 4:
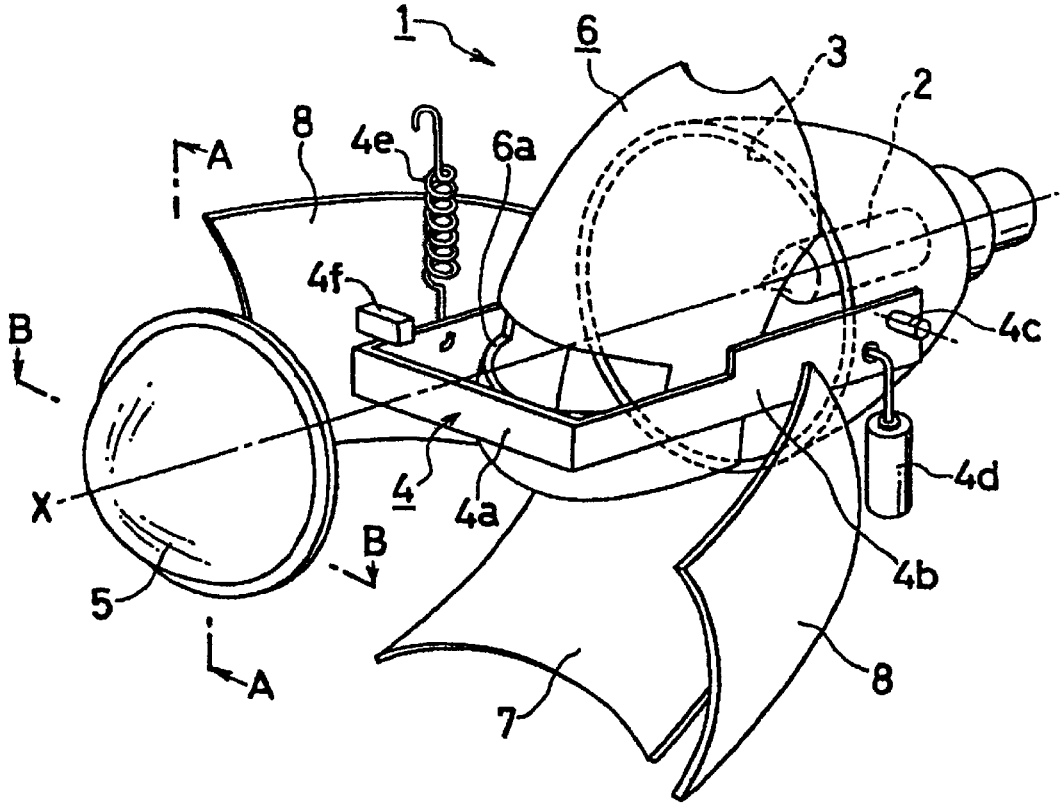
FIG. 4 is a perspective view of one of the preferred embodiments of the vehicle headlight made in accordance with the principles of the present invention.
Figure 5:
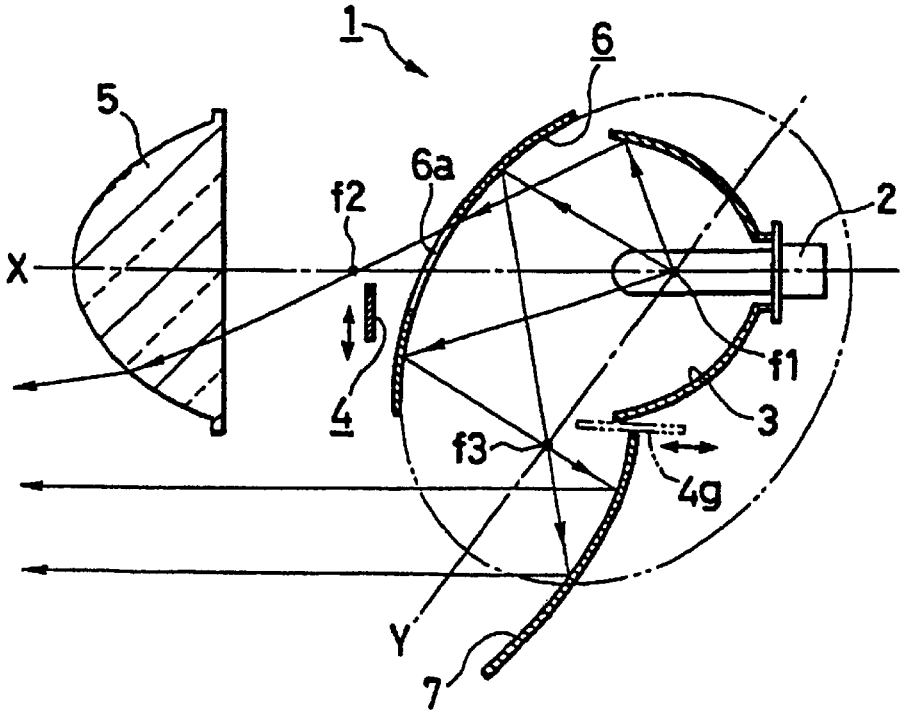
FIG. 5 is a cross sectional view taken along the line A—A in FIG. 4.
Figure 6:
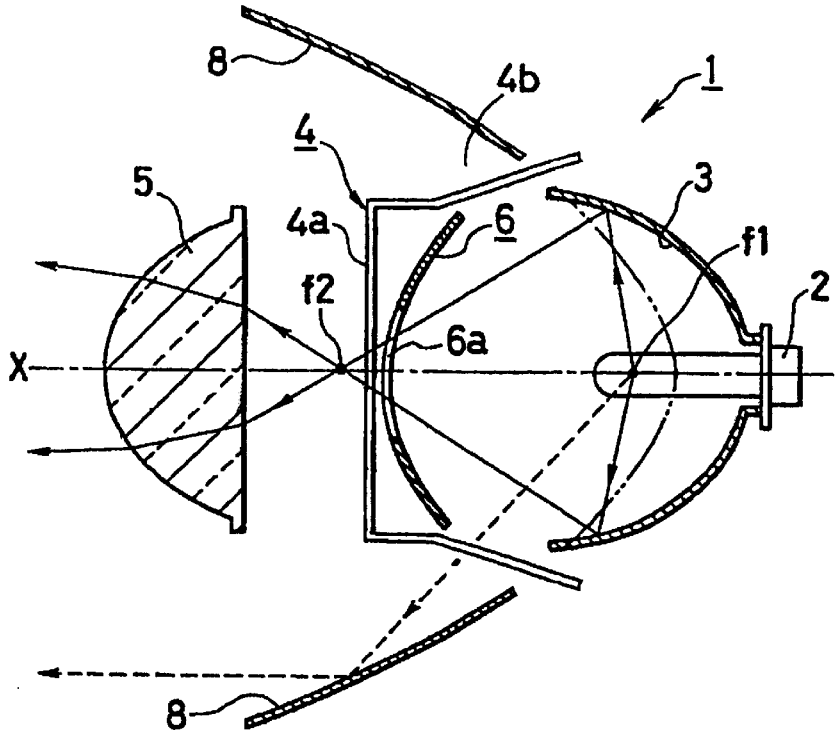
FIG. 6 is a cross sectional view taken along the line B—B in FIG. 4.

Referring now to FIGS. 4 to 6, there is shown a vehicle headlight denoted by reference numeral 1 which depicts one of the preferred embodiments of the present invention. The vehicle headlight 1 can include a light source 2, a first ellipse group reflecting surface 3, a movable shutter 4, and a projection lens 5. The first ellipse group reflecting surface 3 is preferably constructed of a spheroid surface, a complex ellipse surface, or the like and is a reflecting surface having an optical axis (axis of lens) X substantially corresponding to the direction of irradiation of light from the vehicle headlight 1. The reflecting surface 3 has a first focus f1 and a second focus f2. The light source 2 can be arranged substantially on the first focus f1. The movable shutter 4 is preferably arranged in the vicinity of the focus f2 of the projection lens 5 (the second focus f2 of the first ellipse group reflecting surface 3) and is responsible for shading a part of reflected light from the first ellipse group reflecting surface 3 to provide the low-beam distribution pattern. Accordingly, such a configuration of the headlight 1 is capable of irradiating light with a low-beam distribution when, for example, the vehicle runs on an urban road at night.

In the present invention, a second ellipse group reflecting surface 6, a first parabolic group reflecting surface 7, and a second parabolic group reflecting surface 8 can be provided in addition to the first ellipse group reflecting surface 3. The present invention solves several problems that exist in the conventional art, including the above problems of: an insufficient amount of light in each of the low- and high-beam light distribution; and the characteristic of insufficient high-beam light distribution which occurs if the movable shutter 4 is withdrawn from an optical path of the reflected light from the first ellipse group reflecting source 3.

First, the second ellipse group reflecting surface 6 and the first parabolic group reflecting surface 7 will be described. These two reflecting surfaces 6 and 7 are provided for various reasons, including supplementing the amount of light appropriate for both the low- and high-beam distributions. As shown in FIGS. 4 and 5, the second ellipse group reflecting surface 6 can be configured as a spheroid surface or the like in which the light source 2 is arranged on a position corresponding to the first focus f1 (the focus position f1 is shared between the first focus f1 of the first ellipse group reflecting surface 3 and the first focus f1 of the second ellipse group reflecting surface 6). The optical axis Y of the reflecting surface 6 can be set such that the focus f3 of the reflecting surface 6 on the optical axis Y is diagonally located forward of the first focus f1 in a downward direction to intersect the optical axis X of the first ellipse group reflecting surface 3 at the light source 2.

The second ellipse group reflecting surface 6 can be arranged such that it does not interfere with an optical path from the light source 2 to the first ellipse group reflecting surface 3 and an optical path of reflected light from the first ellipse group reflecting surface 3. More specifically, the reflecting surface 6 can be located forward of the first ellipse group reflecting surface 3 and provided such that a mirror surface (the actual reflecting surface) is directed to the light source 2 for receiving light directly irradiated from the light source 2. If necessary, furthermore, there is formed an opening portion 6*a* through which direct light and reflected light from the first ellipse group reflecting surface 3 can pass. The opening portion 6*a* is preferably configured such that a part of the opening portion 6*a* is shaded when the movable shutter 4 moves into the optical path, and such that the opening portion 6*a* is completely opened when the movable shutter 4 is withdrawn from the optical path.

In the present invention, additionally, the second ellipse group reflecting surface 6 can be configured so as to be located nearer the light source 2 than the second focus f2 of the first ellipse group reflecting surface 3. Therefore, the movable shutter 4 that is preferably provided in the vicinity of the second focus f2 is located on the back side of the second ellipse group reflecting surface 6, so that there is no possibility of mechanically interfering with the second ellipse group reflecting surface 6.

The headlight of the above described embodiment can be constructed such that the second ellipse group reflecting surface 6 is capable of capturing the light emitted from the light source 2 which cannot be captured by the first ellipse group reflecting surface 3. Thus, light can converge to the focus f3 of the reflecting surface 6. In this embodiment, furthermore, there can be provided a first parabolic group reflecting surface 7 for reflecting the above described light that has converged to the focus f3, and forwarding it in the irradiation direction of the headlight.

The first parabolic group reflecting surface 7 can be formed as a parabolic shaped reflecting surface such as a paraboloid of revolution. The optical axis of the reflecting surface 7 can substantially correspond to the irradiation direction of light irradiating from the vehicle headlight 1. In addition, the focus of the reflecting surface 7 can substantially correspond to the focus f3 of the second ellipse group reflecting surface 6. Therefore, the light captured and reflected by the second reflecting surface 6 can be reflected by the first parabolic group reflecting surface 7 substantially in the direction of light irradiating from the vehicle headlight 1 as parallel light.

As shown in FIGS. 4 and 6, the second parabolic group reflecting surface 8 can include a pair of reflecting surfaces, one on each of the left and right sides of the first ellipse group reflecting surface 3 in the horizontal direction. The optical axis of the second parabolic group reflecting surface 8 substantially corresponds to the irradiation direction of light irradiating from the vehicle headlight 1. The focus of the reflecting surface 8 preferably corresponds to the position of the light source 2. If the reflecting surface 8 is provided in the above position, it should be provided so as not to cause any interference problems such as overlap with the second ellipse group reflecting surface 6.

In the above configuration of the headlight, a low-beam distribution pattern can be attained by shading a high beam (upwardly directed light) by placing the movable shutter 4 in the flux of reflected light from the first ellipse group reflecting surface 3. If a high-beam distribution pattern is required, the movable shutter 4 can be withdrawn from the flux of reflected light from the first ellipse group reflecting surface 3. In the present invention, the movable shutter 4 can include a shutter part 4*a* to be placed in or withdrawn from the light flux from the first ellipse group reflecting surface 3. A shade part 4*b* can be placed in or withdrawn from the light flux directly transmitted from the light source 2 to the second parabolic group reflecting surface 8. In FIG. 4, the upper end of the shutter part 4*a* is shaped like a straight line. However, the present invention is not limited thereto, and if desired, the upper end of the shutter part 4*a* may be shaped into one of various cut lines or curved lines, depending on the desired light distribution pattern. Further, a connecting portion which connects the shutter part 4*a* and the shade part 4*b* may include a fold as shown in FIG. 6, although the fold is not shown in FIG. 4 for easy understanding. However, the fold is not necessarily included in the movable shutter 4, and the connecting portion which connects the shutter part 4*a* and the shade part 4*b* may be a straight line in the B—B cross section of FIG. 4.

The movable shutter 4 can be rotatably fixed on a horizontal axis 4*c* and is able to be rotated about the horizontal axis 4*c* by a driving force exerted from a driving part 4*d* such as a solenoid. In the movable shutter 4, furthermore, a return spring 4*e* and a stopper 4*f* can be arranged at appropriate positions, respectively. When the movable shutter 4 is not actuated by the driving part 4*d*, the movable shutter 4 is fixed at a predetermined position by means of the return spring 4*e* and the stopper 4*f*. In this position, the movable shutter 4 is not rotated, and a low-beam distribution pattern can be obtained when the movable shutter 4 is located at the predetermined fixed position.

Specifically, when the movable shutter 4 is not actuated by the driving part 4*d*, the shutter part 4*a* moves into or remains in the light flux from the first ellipse group reflecting surface 3 to shade the high beam (upwardly directing light rays). Simultaneously, the shade portion 4*b* shades the light from the light source 2 to the second parabolic group reflecting surface 8.

If the driving part 4*d* is actuated, the shutter part 4*a* is rotated and withdrawn from the light flux from the first ellipse group reflecting surface 3 while the shade part 4*b* is withdrawn from the optical path from the light source 2 to the second parabolic group reflecting surface 8. Consequently, the light from the light source 2 can directly reach the second parabolic group reflecting surface 8. Note that it is possible to obtain either of a low-beam distribution pattern or a high-beam distribution pattern when the driving part 4*d* is being actuated. In nature, however, when a vehicle is moving, the low-beam distribution pattern is predominantly selected. The low-beam distribution setting is advantageous, compared with the high-beam distribution, in terms of a reduction in electric power consumption when the driving part 4*d* is stopped or fixed.

Figure 7:
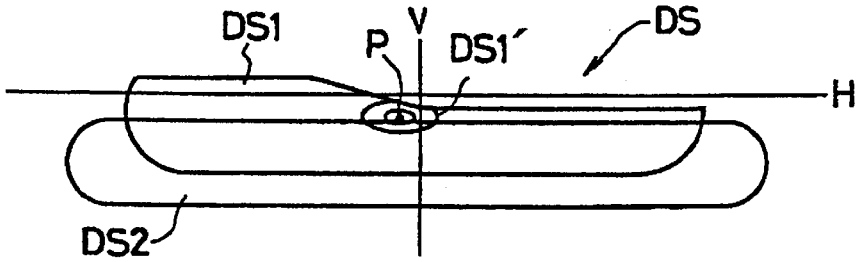
FIG. 7 is an explanatory view showing a low-beam light distribution pattern of the vehicle headlight of FIG. 4.

Next, the operation and effect of the vehicle headlight of the embodiment as constructed above will be described. In FIG. 7, there is shown a low-beam distribution pattern DS of the vehicle headlight 1. In the low-beam distribution, almost half of the reflected light from the first ellipse group reflecting surface 3 is shaded by the movable shutter 4 (the shutter part 4*a*). In this state, however, the low-beam distribution pattern DS is the sum of a distribution pattern DS1 from the first ellipse group reflecting surface 3 and a distribution pattern DS2 from the second ellipse group reflecting surface 6 and the first parabolic group reflecting surface 7 which capture light that has typically not previously been used. Therefore, the low-beam distribution pattern DS can be more brightly lit. Furthermore, the point P in the figure is one where the maximum brightness in each of the distribution patterns can be obtained. In the figure, DS1' indicates a high illumination zone of the distribution pattern DS1 from the first ellipse group reflecting surface 3. Considering that half of the reflected light from the first ellipse group reflecting surface 3 is shaded by the shutter part 4*a*, the first ellipse group reflecting surface 3 is designed such that the maximum brightness point P is located at a position on the left or right side slightly lower than the origin (the front, H=0, V=0) (e.g., the left side if the vehicle runs on the left-hand side). In this embodiment, for example, the optical axis of the first ellipse group reflecting surface 3 is inclined to the lower left side.

Figure 8:
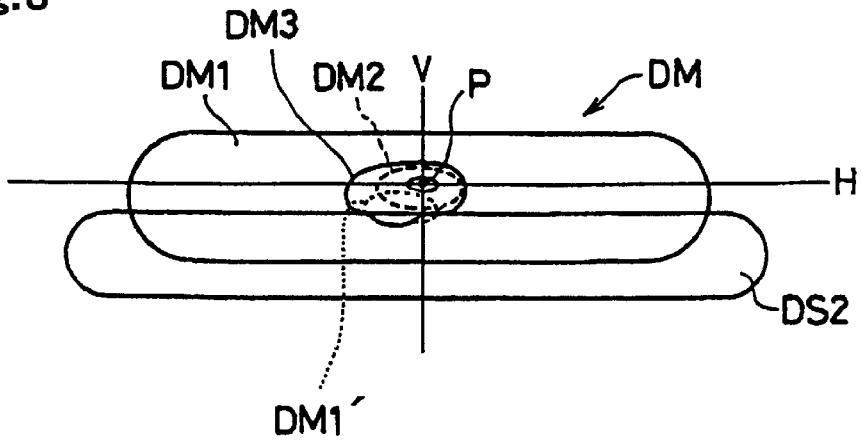
FIG. 8 is an explanatory view showing a high-beam distribution pattern of the vehicle headlight of FIG. 4.

On the other hand, when in the high-beam distribution pattern DM shown in FIG. 8, the movable shutter 4 (the shutter part 4*a*) is preferably withdrawn from the flux of reflected light from the first ellipse group reflecting surface 3. Therefore, the distribution pattern DM1 can be obtained, in which the reflected light from the reflecting surface 3 includes a high beam i.e., upwardly directed light (the lower part of the light in the vicinity of the focus of the projection lens), and irradiated light projected from the projection lens includes a high beam. However, as the optical axis of the first ellipse group reflecting surface 3 is inclined to the lower left side (if the vehicle runs on the left-hand side), the use of the distribution pattern DM1 alone is insufficient to irradiate a considerable distance in front of the vehicle, and it becomes difficult to completely satisfy the functions of the high-beam distribution as described above. In FIG. 8, the border line of the pattern DM1 is indicated by a single contour line of a low illumination zone.

In this embodiment of the invention, the reflected light from the second parabolic group reflecting surface 8 can be adjusted so as to be directed to the vicinity of the origin (the front, H=0, V=0) to obtain the distribution pattern DM2. As a result, a high-beam distribution pattern DM can be obtained that comprises the sum of the distribution pattern DM1, the distribution pattern DM2, and the distribution pattern DS2 from the first parabolic group reflecting surface 7. This combination of light makes up the irradiation light for irradiating outward from the front of the vehicle at a considerable distance, satisfying the functions of high-beam distribution.

In FIG. 8, there is a high illumination zone DM3 of the high-beam distribution pattern DM. The high illumination zone DM3 is composed of a high illumination zone DM1' of the distribution pattern DM1 (i.e., one in the state where the distribution pattern DS1' is not shaded by the shutter part 4*a* as shown in FIG. 7) and the distribution pattern DM2 from the second parabolic group reflecting surface 8. The maximum brightness point P of the high-beam distribution pattern DM is located on the origin (the front, H=0, V=0), resulting in extremely good distance visibility. Note that the zone DM3 is defined by a single contour line in the high illumination zone obtained by synthetically preparing the zone DM1' and the pattern DM2. The border line of the zone DM3 and the border line of the zone DM1' are not limited in the same intensity of illumination.

Because the second parabolic group reflecting surface 8 is preferably provided on each of left and right sides of the first ellipse group reflecting surface 3 in the horizontal direction, the reflected light from the second parabolic group reflecting surface 8 preferably extends wide in the horizontal direction while extending more narrowly in the vertical direction when the light source 2 is relatively long in the axial direction (e.g., axial direction of a C-8 filament). Therefore, the second parabolic group reflecting surface 8 is not able to irradiate light onto the road surface near the front of the vehicle with a great deal of brightness.

In this embodiment, the light being reflected by the second ellipse group reflecting surface 6 and the first parabolic group reflecting surface 7 (i.e., a portion corresponding to the distribution pattern DS2 of the low-beam distribution pattern DS) can remain substantially constant, even though it is in the high-beam distribution that is being switched.

Therefore, the road surface just in front of the vehicle can be irradiated brightly. Thus, it is possible to provide a wide distribution pattern of light with a high intensity of illumination. On the other hand, however, a driver who constantly watches the area close to the front of the vehicle may experience a brightness difference between the close area and the distance area in front of the vehicle. As a result, it is conceivable that visibility to a considerable distance may seem lower, even though it is not lower than in a standard high beam.

Figure 9:
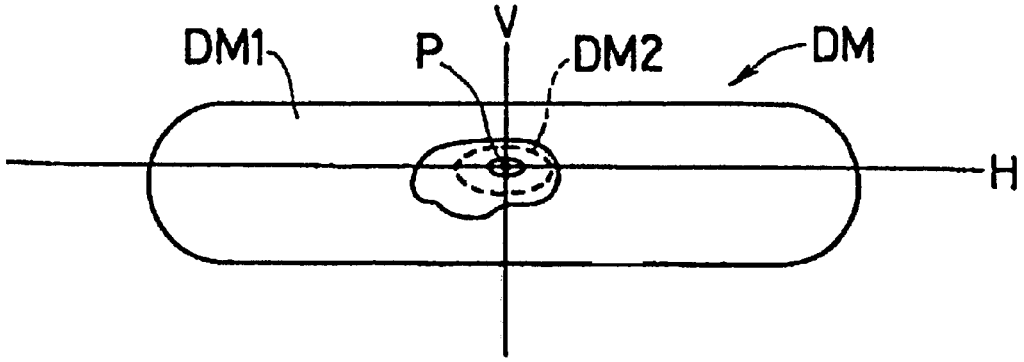
FIG. 9 is an explanatory view showing a high-beam distribution pattern of another preferred embodiment of the vehicle headlight of the present invention.

In this case, when the movable shutter 4 is located in the position where a high-beam distribution pattern can be obtained, a second shade part 4*g* (see FIG. 5) may be provided such that it can be inserted in the vicinity of the focus f3 of the second ellipse group reflecting surface 6, for example. According to such a configuration of the headlight, when it is switched to provide the high-beam distribution pattern DM, as shown in FIG. 9, the reflected light from the first parabolic group reflecting surface 7 is shaded. The second shade part 4*g* may be integrally formed with the movable shutter 4. Alternatively, the second shade part 4*g* and the movable shutter 4 may be separately formed. They may be driven independently of each other or may be interlocked with each other. Furthermore, if the second shade part 4*g* and the movable shutter 4 are integrally formed so as to be actuatable by the same driving part 4*d*, several advantages can be obtained with respect to reduction in the number of structural components, and the structure of the headlight can be simplified. If the second shade part 4*g* and the movable shutter 4 are separately formed, different desired distribution patterns can be obtained at the time of high-beam distribution.

Figure 10:
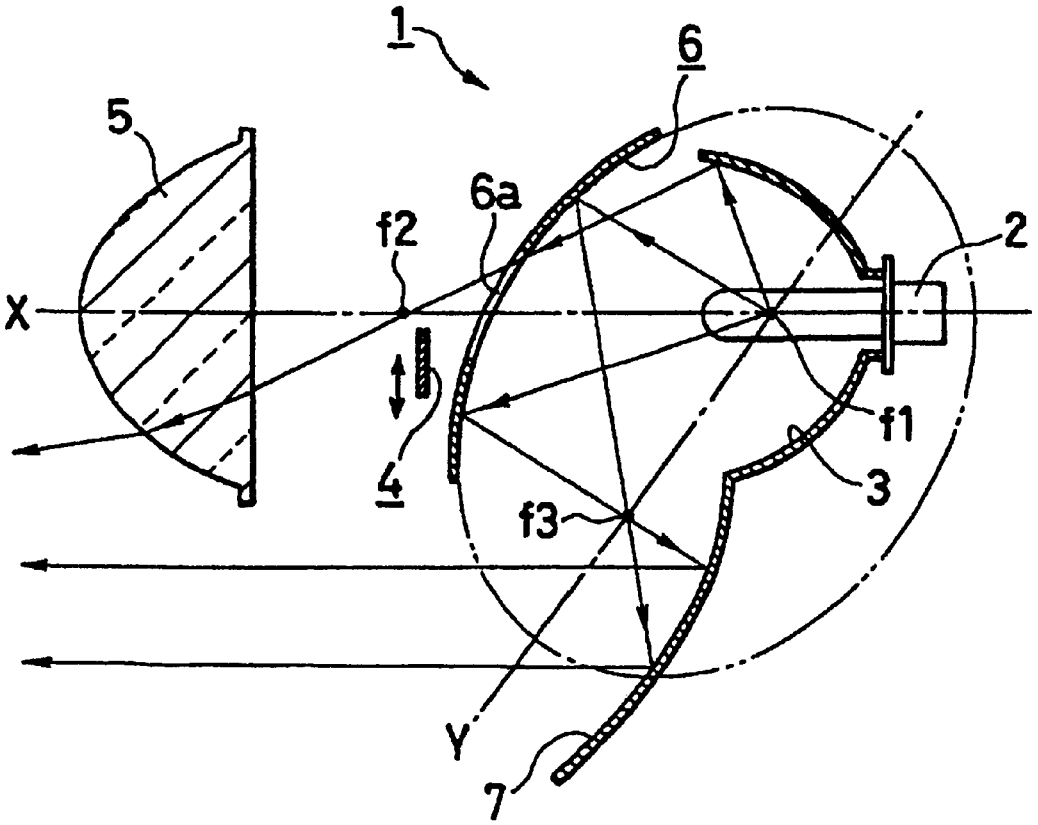
FIG. 10 is a cross-sectional view of another preferred embodiment of the invention.

In accordance with another embodiment of the present invention, though not shown in the figures, the position of the second ellipse group reflecting surface 6 is not limited to be in a slanting upper direction of the first ellipse group reflecting surface 3. Alternatively, it may be formed and/or positioned in a slanting lower direction or the like. Furthermore, the optical axis of the first parabolic group reflecting surface 7 is not limited to be in the direction X of irradiating light from the vehicle headlight 1, and it may be in the diagonally lateral direction, the lateral direction, or the like. By setting the reflecting surface 7 in such a direction, for example, a distribution pattern of light can be obtained such that the distribution pattern DS2 is located on the outside of the distribution patterns DS1 and DM1. The second parabolic group reflecting surface 8 is not limited to be provided as a pair of reflecting surfaces arranged on opposite lateral sides of the headlight. Rather, it may be arranged only on one side thereof or as a single reflecting surface. Furthermore, the headlight can be configured for the purpose of obtaining a desired distribution pattern as a whole by providing headlights arranged on both left and right sides of the vehicle. Furthermore, as shown in FIG. 10, the first ellipse, group reflecting surface 3 and the first parabolic group reflecting surface 7 can be formed as a continuous surface. Further, the first ellipse group reflecting surface 3 and the second parabolic group reflecting surface 8 can be formed as a continuous surface depending on locations of the solenoid 4*d*, the spring 4*e*, and the stopper 4*f* A movable or stationary second shade 4*g* can be placed in front of the first ellipse group reflecting surface 3 or the first parabolic group reflecting surface 7.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A vehicle headlight having an irradiation direction, comprising:

a light source;

a first ellipse group reflecting surface having an optical axis direction substantially corresponding to the irradiation direction of the headlight, the first ellipse group reflecting surface having a first focus and a second focus, the first focus being located substantially at the light source, the first ellipse group reflecting surface configured to reflect light irradiated from the light source in the irradiation direction of the headlight;

a projection lens having a focus in the irradiation direction of the headlight and in the vicinity of the second focus of the first ellipse group reflecting surface, the projection lens configured to project light irradiated from the light source and light reflected from the first ellipse group reflecting surface in the irradiation direction;

a second ellipse group reflecting surface having an optical axis crossing the optical axis of the first ellipse group reflecting surface, the second ellipse group reflecting surface having a primary focus and a secondary focus, the primary focus of the second ellipse group reflecting surface located substantially at the light source;

a first parabolic group reflecting surface having a focus located substantially at the secondary focus of the second ellipse group reflecting surface, the first parabolic group reflecting surface configured to reflect light reflected from the second ellipse group reflecting surface in the irradiation direction of the headlight;

a second parabolic group reflecting surface having an optical axis substantially corresponding to the irradiation direction of the headlight, the second parabolic group reflecting surface having a focus located in the vicinity of the light source, the second parabolic group reflecting surface being arranged in the irradiation direction side from the first ellipse group reflecting surface; and a shutter provided in the vicinity of the focus of the projection lens, the shutter being capable of being placed in and withdrawn from an optical path of light reflected from the first ellipse group reflecting surface, the shutter having a shutter part and a shade part, the shutter part providing a low-beam light distribution pattern by being placed in the optical path of the reflected light from the first ellipse group reflecting surface and providing a high-beam light distribution pattern by being withdrawn from the optical path, the shade part shading light traveling from the light source to the second parabolic group reflecting surface when the shade is in a first position, and providing light from the light, source to the second parabolic group reflecting surface when the shade is in a second position.

2. The vehicle headlight according to claim 1, wherein the first ellipse group reflecting surface and the second ellipse group reflecting surface are arranged such that the second focus of the first ellipse group reflecting surface is located outside of the second ellipse group reflecting surface, and the shutter part of the shutter is located on a back side of the second ellipse group reflecting surface when the shutter part is withdrawn from the optical path of the light reflected from the first ellipse group reflecting surface.

3. The vehicle headlight according to claim 1, wherein the shutter is rotatably fixed on a substantially horizontal axis such that it can be placed in or be withdrawn from the optical path.

4. The vehicle headlight according to claim 1, wherein the second parabolic group reflecting surface includes a pair of reflecting surfaces, one provided on a left side and one provide on a right side of the first ellipse group reflecting surface as viewed in a front horizontal direction such that the second parabolic group reflecting surface receives direct light from the light source when the shutter is withdrawn from the optical path.

5. The vehicle headlight according to claim 1, further comprising means for shading the light reflected from the second ellipse group reflecting surface to the first parabolic group reflecting surface during high-beam light distribution.

6. The vehicle headlight according to claim 5, wherein the means for shading is driven independently of the shutter.

7. The vehicle headlight according to claim 5, wherein the means for shading is interlocked with the shutter.

8. The vehicle headlight according to claim 5, wherein the means for shading and the shutter are rotatable around a substantially horizontal axis.

9. The vehicle headlight according to claim 1, wherein the second ellipse group reflecting surface has an opening portion coinciding with a portion of a light path of irradiation light from the light source and reflected light from the first ellipse group reflecting surface to the projection lens.

10. The vehicle headlight according to claim 9, wherein the shutter shades a part of the opening portion when it is placed in the optical path and opens the opening portion when it is withdrawn from the optical path.

11. The vehicle headlight according to claim 1, wherein an optical axis of the first parabolic group reflecting surface substantially corresponds to the irradiation direction of the headlight.

12. The vehicle headlight according to claim 1, wherein an optical axis of the first parabolic group reflecting surface is set such that the light reflected from the first parabolic group reflecting surface irradiates along a side of an area irradiated by the light reflected from the first ellipse group reflecting surface.

13. The vehicle headlight according to claim 6, wherein the means for shading and the shutter are rotatable around a substantially horizontal axis.

14. The vehicle headlight according to claim 7, wherein the means for shading and the shutter are rotatable around a substantially horizontal axis.

15. The vehicle headlight according to claim 1, wherein an optical axis of the first parabolic group reflecting surface is spaced from and substantially parallel to the optical axis of the first ellipse group reflecting surface.

16. The vehicle headlight according to claim 1, wherein the first ellipse group reflecting surface and the first parabolic group reflecting surface are configured to be a continuous surface.

17. A vehicle headlight, comprising:

a light source;

a first reflecting surface located adjacent the light source, the first reflecting surface having a first focus located substantially at the light source and the first reflecting surface being configured to reflect light irradiated from the light source in an irradiation direction of the headlight;

a projection lens located adjacent the first reflecting surface and configured to project light that is irradiated from the light source in the irradiation direction;

a second reflecting surface having an optical axis at an angle with respect to the optical axis of the first reflecting surface, the second reflecting surface having a primary focus and a secondary focus, the primary focus being located substantially at the light source;

a third reflecting surface having a focus located substantially at the secondary focus of the second reflecting surface, the third reflecting surface being configured to reflect light reflected from the second reflecting surface in the irradiation direction of the headlight; and a fourth reflecting surface having an optical axis substantially corresponding to the irradiation direction of the headlight, the fourth reflecting surface having a focus located in the vicinity of the light source.

18. The vehicle light of claim 17, further comprising:

a shutter provided in the vicinity of the focus of the projection lens, the shutter capable of being placed in and withdrawn from the optical path of light reflected from the first reflecting surface, the shutter having a shutter part and a shade part, the shutter part providing a low-beam light distribution pattern by being placed in the optical path of the light reflected from the first reflecting surface and providing a high-beam light distribution pattern by being withdrawn from the optical path, the shade part shading light traveling from the light source to the fourth reflecting surface when the shade is in a first position, and providing light from the light source to the fourth reflecting surface when the shade is in a second position.

19. The vehicle headlight according to claim 17, wherein the second reflecting surface includes an opening through which light from the light source can pass.

20. The vehicle headlight according to claim 19, further comprising:

a shutter located adjacent the opening in the second reflecting surface and moveable between a high-beam position and a low-beam position.

21. The vehicle headlight according to claim 17, wherein the light reflected by the first reflecting surface is directed along a first linear path, and light reflected by the third reflecting surface is directed along a second linear path, the first and second linear paths being substantially parallel and spaced from each other.

* * * * *